US005881425A

United States Patent [19]

Hudson et al.

[11] Patent Number: 5,881,425

[45] Date of Patent: Mar. 16, 1999

[54] RECYCLED AND RECYCLABLE TOOTHBRUSH HAVING BRISTLE AND HANDLE CONFIGURATIONS FOR IMPROVED ORAL HYGIENE

[75] Inventors: Eric C. Hudson, Cambridge, Mass.; Fred L. Hudson, Jr., Miami, Fla.

[73] Assignee: Recycline, Inc., Somerville, Mass.

[21] Appl. No.: 706,818

[22] Filed: Sep. 3, 1996

[51] Int. Cl.[6] ..... A46B 9/04

[52] U.S. Cl. ..... 15/167.1; 15/143.1

[58] Field of Search ..... 15/143.1, 167.1, 15/167.2; D4/104, 132, 134

[56] References Cited

U.S. PATENT DOCUMENTS

| | | | |
|---|---|---|---|
| D. 136,042 | 7/1943 | Veo | D4/104 |
| D. 342,161 | 12/1993 | Curtis et al. . | |
| D. 342,162 | 12/1993 | Curtis et al. . | |
| D. 358,485 | 5/1995 | Crawford et al. . | |
| D. 358,486 | 5/1995 | Loew . | |
| D. 358,711 | 5/1995 | Sherman et al. . | |
| D. 358,712 | 5/1995 | Loew . | |
| D. 358,713 | 5/1995 | Perry . | |
| D. 359,851 | 7/1995 | Loew . | |
| D. 360,076 | 7/1995 | Schneider . | |

(List continued on next page.)

FOREIGN PATENT DOCUMENTS

| | | |
|---|---|---|
| 0648449 | 4/1995 | European Pat. Off. . |
| 2649597 | 3/1991 | France . |

OTHER PUBLICATIONS

Finkelstein et al., "The Clinical Quantitative Assessment of the Mechanical Cleaning Efficiency of Toothbrushes," *Clinical Preventive Dentistry,* vol. 6, No. 3, pp. 7–12, May–Jun. 1984.

Park et al., "Choosing an Effective Toothbrush," *Clinical Preventive Dentistry,* vol. 7, No. 4, pp. 5–9, Jul.–Aug. 1985.

Wilkins, *Clinical Practice of the Dental Hygienist* pp. 301–312, Sixth Edition, Lea & Febiger, Philadelphia, 1989.

Mulry et al., "A Comparison of the end–Rounding of Nylon Bristles in Commercial Tooth–brush–es: Crest Complete® and Oral–B®," *Jnl. of Clinical Dentistry,* vol. III, No. 2, pp. 47–50, 1992.

"SmithKline flexes $35M for new brush," *Advertising Age,* p. 48, Aug. 16, 1994.

Oral–B® Toothbrush product literature, 1995.

Radius Toothbrush advertisement, *Supermarket News,* p. 51, May 15, 1995.

*Primary Examiner*—Terrence R. Till
*Attorney, Agent, or Firm*—Theresa A. Lober

[57] ABSTRACT

A toothbrush including a head region in which is secured bristles on the top side of the head region, along at least a portion of the length of the head region. A neck region is connected to the head region and an elongated gripping region is connected to the neck region. The head and neck regions are both angled backward from the gripping region. An end rest region having a generally flat bottom surface is connected to the gripping region. The gripping region arches frontward of both the neck and end rest regions. The head and other handle regions of the toothbrush are of a material composition at least a portion of which is recycled plastic; preferably, the material composition is at least about 90% recycled plastic. At the time of disposal of the toothbrush of the invention, say, when its bristles are worn out, the entire toothbrush can be preferably recycled instead of included in non-recyclable trash. The toothbrush bristles are configured as a row of columns of spaced-apart tufts of end-rounded bristles. An inner-most column of bristle tufts is of a first height along the entire length of the inner-most column; outer-most bristle tuft columns are each of a second height that is greater than the first height along their entire lengths; and intermediate bristle tuft columns are of intermediate heights that are between the first and second heights along their entire lengths. The inner-most column is of a first length, the outer-most bristle tuft columns are each of a second length that is less than the first length, and the intermediate bristle tuft columns are of intermediate lengths between the first and second lengths.

19 Claims, 2 Drawing Sheets

U.S. PATENT DOCUMENTS

| | | | |
|---|---|---|---|
| 1,369,966 | 3/1921 | Cosens et al. | 15/167.1 |
| 2,168,964 | 8/1939 | Strasser | 15/167.1 |
| 2,244,615 | 6/1941 | Garcin . | |
| 2,722,703 | 11/1955 | Green | 15/167.1 |
| 3,678,528 | 7/1972 | Haijie | 15/167.1 |
| 3,691,585 | 9/1972 | Flom | 15/167.1 |
| 4,020,521 | 5/1977 | Velasquez . | |
| 4,274,174 | 6/1981 | Ertel | 15/143.1 |
| 4,351,080 | 9/1982 | Grossman . | |
| 4,672,706 | 6/1987 | Hill . | |
| 4,679,273 | 7/1987 | Okin . | |
| 4,712,267 | 12/1987 | Cheng . | |
| 4,847,936 | 7/1989 | Moglianesi et al. . | |
| 4,882,803 | 11/1989 | Rogers et al. . | |
| 4,894,880 | 1/1990 | Aznavoorian . | |
| 5,046,213 | 9/1991 | Curtis et al. . | |
| 5,052,071 | 10/1991 | Halm | 15/167.1 |
| 5,305,489 | 4/1994 | Lage | 15/167.1 |
| 5,392,483 | 2/1995 | Heinzelman et al. . | |
| 5,396,678 | 3/1995 | Bredall et al. . | |
| 5,396,679 | 3/1995 | Brown et al. . | |
| 5,398,367 | 3/1995 | Lu . | |
| 5,419,001 | 5/1995 | Wan . | |
| 5,459,899 | 10/1995 | Bauer . | |
| 5,517,712 | 5/1996 | Schiano | 15/167.1 |
| 5,517,713 | 5/1996 | Hadcock | 15/167.1 |

RECYCLED AND RECYCLABLE TOOTHBRUSH HAVING BRISTLE AND HANDLE CONFIGURATIONS FOR IMPROVED ORAL HYGIENE

FIELD OF THE INVENTION

This invention relates to toothbrush designs for promoting oral hygiene, and more particularly relates to toothbrushing techniques that address both soft and hard oral tissue. This invention also relates to materials for producing toothbrush handles.

BACKGROUND OF THE INVENTION

Manual toothbrushing is the most widely-used oral hygiene practice and is recognized as an effective technique for removal of bacterial plaque. But it is generally agreed that typical toothbrushing techniques and conventional toothbrushes are successful at removing plaque only substantially from portions of the hard oral tissue, i.e., tooth surfaces. Soft oral tissue and the hard oral tissue just adjacent to it are generally not well-addressed by conventional toothbrushes. In particular, the free gingival margin of soft oral tissue, that is, the portion of gingivae that overlap the teeth crowns, and the gingival sulcular region, located between the free gingival margin and the teeth crowns, are not generally well-addressed by conventional toothbrushes. As a result, typical toothbrushing techniques promote removal of plaque from only the teeth surfaces above the gingival margin, while not adequately cleaning the gingivae and sulcular regions. Yet cleaning of the gingivae and sulcular regions is required to control periodontal disease.

A wide range of toothbrush configurations have been proposed for promoting cleaning of both hard and soft oral tissue through toothbrushing. For example, out-of-line toothbrush handle orientations and nonuniform toothbrush bristle configurations have been suggested. Although such configurations in general do typically achieve some gains in promotion of improved toothbrushing over conventional toothbrushes, they generally do not optimally enable proper cleaning of both soft as well as hard oral tissue.

SUMMARY OF THE INVENTION

The present invention overcomes limitations of past toothbrush configurations to more optimally address both soft and hard oral tissue for promoting improved oral hygiene. In accordance with the invention there is provided a toothbrush including a head region in which is secured bristles on the top side of the head region, along at least a portion of its length. A neck region is connected to the head region and an elongated gripping region is connected to the neck region. The head and neck regions are both angled backward from the gripping region. An end rest region having a generally flat bottom surface is connected to the gripping region. The gripping region arches frontward of both the neck and end rest regions.

In various embodiments, a support region is provided between the gripping region and the end rest region; the gripping region arches frontward of the support region, which curves backward toward the end rest region. Preferably, the neck, gripping, and support regions are elliptical in cross section. At least one handle grip preferably protrudes from a surface of the toothbrush at a location in the gripping region. The head and neck regions of the toothbrush are at a common backward angle with respect to the gripping region, that backward angle preferably being between about ten and twenty degrees.

In another aspect of the invention, the bristles secured in the toothbrush head are configured as a row of columns of spaced-apart tufts of rounded bristles. An inner-most column of bristle tufts is of a first height along the entire length of the inner-most column; outer-most bristle tuft columns are each of a second height that is greater than the first height along their entire lengths; and intermediate bristle tuft columns are each of an intermediate height that is between the first and second heights along their entire lengths.

Preferably, the inner-most column is of a first length along the toothbrush head, the outer-most bristle tuft columns are each of a second length that is less than the first length, and the intermediate bristle tuft columns are each of an intermediate length that is between the first and second lengths. The bristle tufts in each column are offset length-wise from bristle tufts in adjacent columns. Five bristle tuft columns are preferably provided.

The handle and bristle configurations provided by the toothbrush of the invention enable the ability to address teeth surfaces, including interior surfaces of posterior teeth, at any angle, and particularly at an angle of about forty five degrees with respect to the horizontal. When the toothbrush is positioned at this angle on a tooth, the tooth's sulcular region, gingival margin, and hard tooth surfaces are all addressed by brush bristles. The Bass brushing technique employs this angular addressing of the tooth to fully clean the sulcular region and gingival margin, and the toothbrush of the invention goes further to enable simultaneous cleaning of both these and hard tooth surfaces.

The handle and bristle configurations also cooperate to provide a form that fits very well in either hand when used to address the teeth at the proper angle. The handle arch provides a form that supports the natural curve of the hand as it holds the handle and angles the head in the correct manner. The toothbrush accordingly provides an optimal geometry that makes use of a backward sloping toothbrush head comfortable and uncomplicated, thereby enabling the Bass technique for more effective teeth cleaning than is generally achieved by conventional in-line or forward- or backward-sloping toothbrush heads.

In a further aspect of the invention, the head region and handle region of the toothbrush both are of a material composition at least a portion of which is recycled plastic that can again be recycled; preferably, the material composition is at least about 90% recycled plastic. In various embodiments, the recycled plastic is recycled polypropylene. At least a portion of the recycled plastic is post-consumer recycled plastic. The bristle tufts are nylon bristles.

At the time of disposal of the toothbrush of the invention, for example, when its bristles are worn out, the entire toothbrush can be preferably recycled instead of included in non-recyclable trash. Recycling of the entire toothbrush, including, e.g., its nylon bristles, can produce a strong plastic-based material that can be used for, e.g., making plastic lumber or other plastic structures. Being itself substantially produced of recycled materials, the recyclable toothbrush thereby is part of a recycling circle that has minimal impact on the environment, both by reducing the volume of post-consumer plastic that might otherwise expand land fills as well by providing a product no part of which cannot be included in recycling.

Other features and advantages of the invention will be apparent from the claims, and from the following description and accompanying drawings.

DESCRIPTION OF PREFERRED EMBODIMENTS

Figure 1:
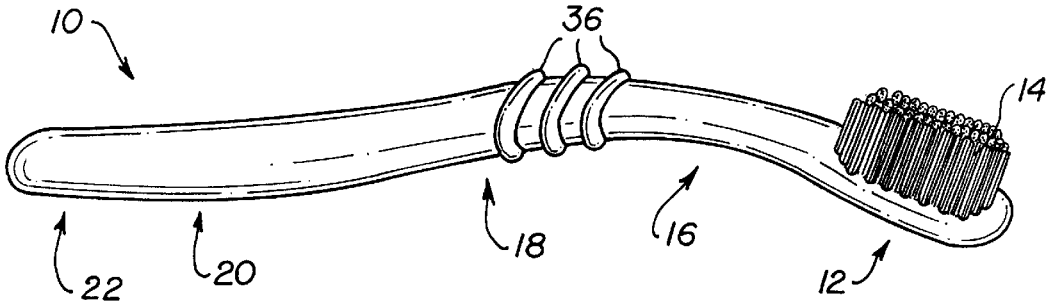
FIG. 1 is a perspective view of the toothbrush of the invention.
Figure 2:
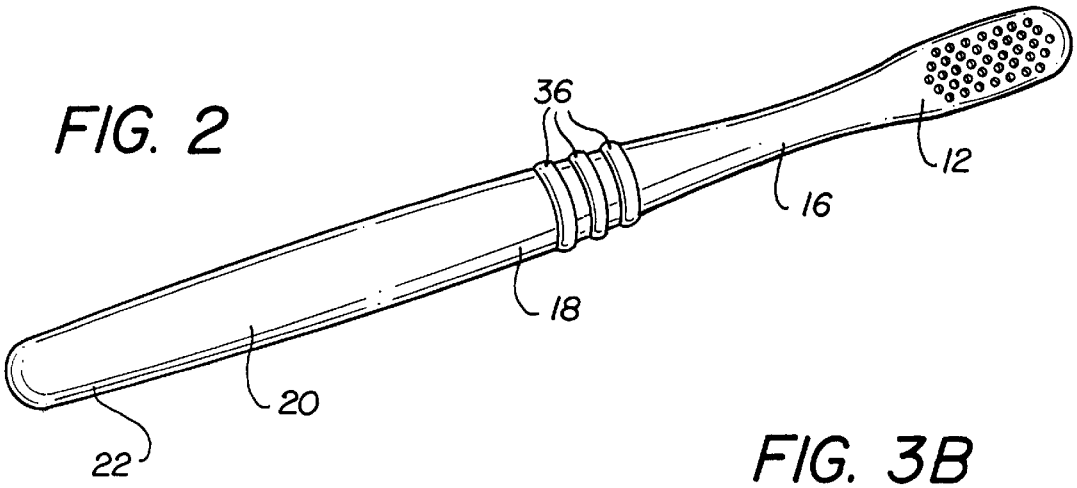
FIG. 2 is a top-down view of the toothbrush of the invention.
Figure 3B:
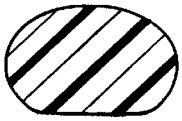
FIG. 3B is a cross-sectional view of the end rest region of the toothbrush of the invention, taken at B—B in FIG. 3A.
Figure 3A:
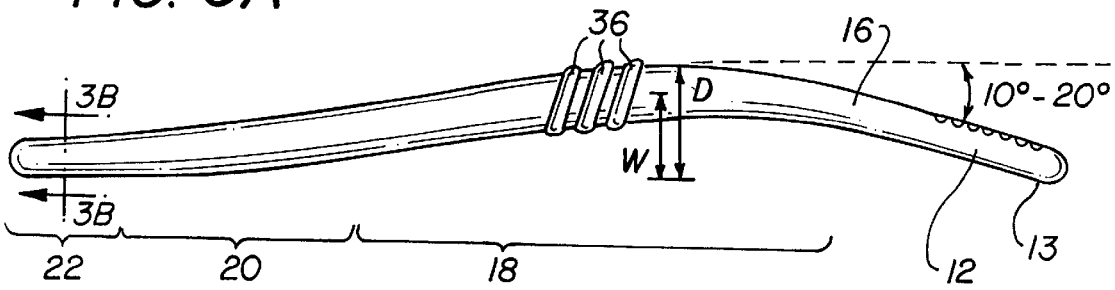
FIG. 3A is a side-view of the toothbrush of the invention.

Referring to FIGS. 1–3, there is shown the toothbrush 10 of the invention. The toothbrush includes a head region 12 into which are secured brushing bristles 14, a neck region 16, a gripping region 18, a hand support region 20, and an end rest region 22. Together with the bristle configuration provided by the invention, as described below, the handle configuration of the toothbrush promotes and encourages a brushing motion known as the so-called Bass brushing technique, which is recommended for optimal manual cleaning of both hard and soft oral tissue. Specifically, the Bass technique is widely accepted as the most effective manual toothbrushing method for removing bacterial plaque from the gingival margin and sulcular regions. Use of the toothbrush of the invention in the Bass technique will be described in more detail after the features of the toothbrush are first specified.

As shown in FIG. 1 and more explicitly in FIG. 3, which is a side profile view of the toothbrush handle, the head 12 and neck 16 of the toothbrush handle slope backward of the handle gripping region 18. Preferably, the head and neck regions are at an angle of between about ten and twenty degrees, and more preferably at an angle of about fifteen degrees back from a plane horizontal with the gripping region. The remaining toothbrush handle regions, namely, the gripping region 18, hand support region 20, and end rest region 22, together form a generally spoon-like curvature. Specifically, the gripping region 18 generally arches upward, as seen in a side profile view such as that of FIG. 3, while the hand support region 20 generally arches downward, and the end region is relatively flat.

Figure 4:
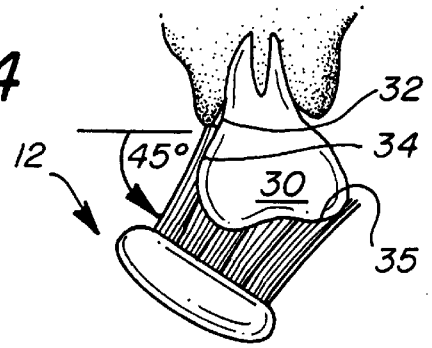
FIG. 4 is a front-end view of the toothbrush of the invention in use in a preferred toothbrushing position relative to tooth surfaces in accordance with the invention.

This handle configuration enables advantages for improved toothbrushing over conventional toothbrushes. The backward slope of the head and neck regions enable the ability to address all teeth surfaces, including exterior and interior surfaces of posterior teeth, at an angle of about forty five degrees with respect to the horizontal. This results in the improved ability to hold the toothbrush handle such that, as illustrated in FIG. 4, the toothbrush head 12 can be positioned at a forty five degree angle on a tooth 30, whereby the tooth's sulcular region 32, gingival margin 34, and hard tooth surfaces 35 are all addressed by the brush bristles. The Bass brushing technique employs this angular addressing of the tooth to fully clean the sulcular region and gingival margin, and the toothbrush of the invention goes further to enable simultaneous cleaning of both these and hard tooth surfaces.

The curvature of the gripping, hand support, and end rest regions cooperate with the backward slope of the head and neck regions to provide a shape that fits very well in either hand when used to address the teeth at an angle. The upward arch of the gripping region provides a comfortable curve for grasping of the handle between the thumb and the second joint of the first finger, and the downward arch of the support region conforms to the natural curve of the palm and other fingers when wrapped around the handle. The end rest region rests comfortably against the bottom of the palm. This handle grasping configuration supports the overall natural curve of the hand as it holds the handle and angles the head in the correct manner.

Conventional in-line and angled toothbrushes do not easily accommodate positioning of a toothbrush head at the prescribed Bass brushing angle on the range of shapes presented by the various teeth. Indeed, conventional toothbrush handle configurations that are typically considered comfortable to use for reaching posterior and interior teeth surfaces do not automatically promote proper Bass technique toothbrush angling. The arching handle regions in the toothbrush of the invention provide a superior geometry that makes using a backward sloping toothbrush head comfortable and uncomplicated, thereby enabling the Bass technique for more effective teeth cleaning than is generally achieved by in-line or conventional forward- or backward-sloping toothbrush heads.

Turning now to one example configuration in accordance with the toothbrush handle of the invention, the head region is about 3.0 cm in length, the neck region is about 2.0 cm-long, the gripping region is about 7.5 cm in length, the support region is about 4.3 cm-long, and the end region is about 2.0 cm-long. The upward profile arch of the gripping region is defined by the distances, D and W, as shown in FIG. 3, taken between the plane horizontal and the top and centerline, respectively, of the highest point in the gripping region arch. Preferably, the largest centerline height W of the arch is between about 15.25–17.25 mm and the largest top line height D of the arch is between about 20–24 mm. The arch angle between the neck region and the top of the arch is greater than the arch angle between the top of the arch and the support region. The downward arch of the support region is a gentle curved slope that makes a continuous transition to the flat end region. Preferably, a small flat region 13 in FIG. 3, is included at the bottom of the head, in the area of the head tip, to add stability to the brush when it is lying on a flat surface.

The toothbrush of the invention further enhances comfort and provides control with one or more grips 36, three of which are shown in the figures. Each grip is preferably formed as a ridge that encircles the handle at some point along the gripping region of the handle. As will be recognized, however, the grips are not required to encircle the handle, and any reasonable number of grips can be employed. In one example configuration, as shown in FIGS. 1–3, three grips are provided, each protruding from the handle by about 0.9 mm, with the grip closest to the handle head being located at a position of about 3 cm from the end of the gripping region closest to the handle neck. As shown in FIG. 3, each grip is aligned with the angle of curvature of the gripping region at the location of the grip. This three-grip configuration preferably coincides with the natural location of the thumb when the toothbrush is held in the hand, thereby providing the feel of a control grip mechanism to enhance toothbrush control by the thumb.

The cross-sectional geometry of each of the handle regions is also designed to enhance control and ease of use of the toothbrush of the invention. As shown in FIGS. 1–3, the handle is formed of a generally elliptical cross section, which changes size along the length of the handle. The elliptical cross section of the support region 20 is generally the largest, with the gripping region being of a smaller elliptical cross section and the neck region being of the smallest elliptical cross section. The head of the toothbrush is elliptical in cross section along its underside and along the sides, and generally flat on the top surface that supports the bristles. The end region is elliptical in cross section along its top side and along the sides, and generally flat on the bottom surface.

The overall elliptical shape of the toothbrush fits comfortably between the thumb and fingers at all handle angles in the wide range of angles needed to brush both exterior and interior surfaces of all of the anterior and posterior teeth. The elliptical nature thereby enables effective Bass technique brushing of all teeth and all teeth surfaces with the hand in a comfortable gripping position. The tapering of the elliptical cross section corresponds to angling of the handle neck into the mouth during use, i.e., a narrow neck region accommodates maneuvering of the toothbrush in the mouth. The maneuverability of the toothbrush is further enhanced by the curvature of the toothbrush handle; the toothbrush is indeed very comfortable to use at any angle of brushing, whether or not the Bass technique is employed. A specific elliptical handle cross section is not required by the invention, however; as will be recognized, a circular or other cross section can alternatively be employed. Table 1 below provides an example elliptical cross section profile for the toothbrush handle.

TABLE 1

| Distance from bottom end | Ellipse short dimension | Ellipse long dimension |
|---|---|---|
| 4.51 mm | 9.01 mm | 12.49 mm |
| 19.86 mm | 7.22 mm | 13.45 mm |
| 39.63 mm | 8.60 mm | 14.35 mm |
| 59.45 mm | 9.20 mm | 14.95 mm |
| 79.43 mm | 9.70 mm | 14.80 mm |
| 99.33 mm | 10.00 mm | 13.40 mm |
| 118.98 mm | 9.24 mm | 10.69 mm |
| 138.92 mm | 7.60 mm | 8.70 mm |
| 149.17 mm | 6.90 mm | 8.80 mm |
| 158.67 mm | 6.50 mm | 11.35 mm |
| 173.81 mm | 6.00 mm | 13.50 mm |
| 181.85 mm | 6.00 mm | 12.29 mm |

With this elliptical profile, the toothbrush handle can be easily and comfortably manipulated at any angle, and thus can be used in the Bass brushing technique throughout the mouth.

Turning now to the toothbrush bristle configuration provided by the invention, as shown in FIGS. 1–3 and 5A–B, the bristles are aligned in rows across the width of the toothbrush head and aligned in columns along the length of the toothbrush head. Each row and column of bristles includes spaced-apart bristle tufts each of a plurality of bristles. Preferably, the length of the columns of bristle tufts is varied across the width of the toothbrush head, with the column length at the center of the head being longest and the column length at the edges of the head being shortest. This results in bristle tufts that are spaced apart and juxtaposed across the handle head.

Figure 6:
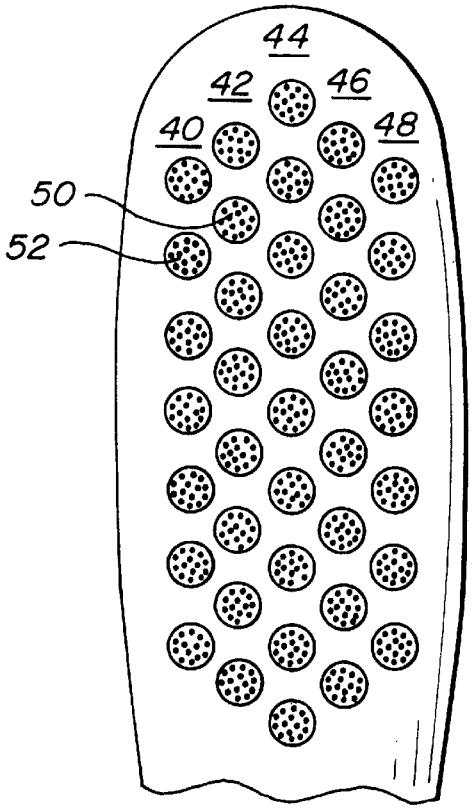
FIG. 6 is a schematic top-down view of a bristle tuft array configuration in accordance with the invention.

For example, as shown in FIG. 6, with five columns 40, 42, 44, 46, and 48 of bristle tufts provided, preferably the inner-most column 44 is the longest, the adjacent two columns 42, 46 are shorter than the inner-most column, and the outer two columns 40, 48 are the shortest. In one example configuration, the inner-most column 44 includes nine tufts of bristles spaced apart along a column of between about 25 mm–27 mm in length. The two columns 42, 46 adjacent to the inner-most column 44 each include eight tufts of bristles spaced apart along a column of between about 21 mm and 24 mm in length. The outer two columns 40, 48 each include seven tufts of bristles spaced apart along a column of between about 18 mm and 21 mm in length.

Preferably, the juxtaposition of bristle tufts in each column results in each tuft being offset from those of adjacent columns, as shown in FIG. 6, so that one row of bristle tufts does not include a tuft from each column. In this pattern, for example, the second tuft of bristles 50 in the second column 42 is offset along the head length from the second tuft of bristles 52 in the outer column 40. In one example configuration, the center point of a given bristle tuft in one column is offset along the head length from the center point of bristle tufts in adjacent columns by about 1.5 mm. This offset of bristle tufts provides a bristle pattern that more uniformly addresses tooth surfaces than would a fully-aligned bristle pattern, but, as will be recognized, other bristle tuft alignment patterns can be employed.

Figure 5A:
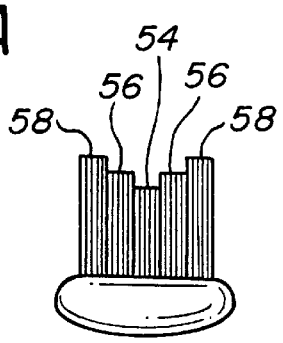
FIG. 5A is a schematic front-end view of a first toothbrush bristle tuft profile in accordance with the invention.
Figure 5B:
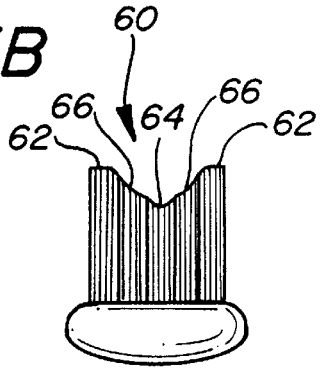
FIG. 5B is a schematic front-end view of a second toothbrush bristle tuft profile in accordance with the invention.

The profile of bristle tufts across one unaligned row of bristle tufts, as shown in FIGS. 5A and 5B, are designed to automatically enable proper Bass technique brushing. In a first bristle configuration in accordance with the invention, shown in FIG. 5A, the height of the bristles in each bristle tuft is stepped from a smallest-height tuft 54 at the center column 44 of the row to largest-height tufts 58 at the outer two columns 40, 48 of the row. For any given number of bristle tuft columns to be included, each bristle tuft column between the inner-most and outer-most columns is stepped at a height between that of the inner-most and outer-most columns, with the height step intervals based on the number of columns included. For example, as shown in FIG. 5A, with five tuft columns included, the two columns 42, 46 adjacent to the inner-most column 44 are formed of medium-height tufts 56. The resulting tri-level stepped profile of bristle tuft heights provides a V-like profile of bristle tuft ends.

Preferably, the height of each column of bristle tufts is constant along the column. Then, as shown in FIG. 1, the V-like bristle profile extends continuously along the entire length of the head of the toothbrush, with the bottom of the V-shape, i.e., smallest-height bristle tuft column, extending the longest distance along the head, and the top sides of the V-shape, i.e., the largest-height and outer-most bristle tuft columns, extending the shortest distance along the head. In one example configuration, the height of the inner-most bristle tuft column is between about 7 mm and 9 mm; the height of the outer-most bristle tuft columns is between about 10 mm and 12 mm; and the height of the bristle tuft columns adjacent to the inner-most column in a five-column configuration is between about 8.5 mm and 10.5 mm.

In a second bristle configuration in accordance with the invention, shown in FIG. 5B, the height of the bristles in each bristle tuft is graded to form a continuous, generally curved bristle cup profile 60. As in the first configuration, bristles in the outer-most columns 62 are of the longest height, bristles in the inner-most column 64 are of the shortest height, and bristles in intermediate columns 66 are of an intermediate height. No matter how many bristle tuft columns are included, the height of each bristle tuft column between the inner-most and outer-most columns is appropriately graded in the continuous cup profile 60 of the configuration.

As in the first bristle configuration, the bristles here are of a constant height along a given bristle tuft column such that a continuous cup profile is provided along the entire toothbrush head. Given that the inner-most bristle tuft column is the longest of the columns, the bottom of the cup profile extends the longest distance along the toothbrush head, with the outer-most tops of the cup profile extending the shortest distance along the toothbrush head. In one example configuration, the outer-most bristle columns are of between about 10 mm and 12 mm in height, the outer-most bristles of the intermediate bristle tuft columns are of between about 8.25 mm and 10.25 mm in height, and the lowest point in the cup profile, in the inner-most bristle tuft column, is of between about 7.25 mm and 9.25 mm in height.

Referring again to FIG. 4, the combination of bristle tuft height profile and bristle tuft column length is employed in the toothbrush of the invention to optimally address tooth surfaces at a forty five degree angle, as called for in the Bass toothbrushing technique. As shown in the figure, when the toothbrush of the invention having either of the bristle configurations described above is held at this angle, the outer-most bristle-tuft columns address the sulcular region 32 and gingival margin 34, as well as the inner area of the tooth surface 35. The relatively long lengths of these bristle tuft columns enables addressing of these areas simultaneously with addressing of the other tooth surfaces by the relatively shorter inner bristles and shortest inner-most bristles.

In the bristle configurations of the invention, the length of each bristle tuft column cooperates with that bristle column's height to provide a degree of bristle flexibility and stability that is optimal for the oral tissue which that column is to designed to address. Specifically, the outer-most bristle tuft columns, being the shortest of all columns and having the largest bristle height, exhibit the highest bristle flexibility of all columns, whereby the bristles of these columns are relatively more wisp-like than bristles of the other columns. This wisp-like flexibility is desired for addressing the sulcular region, which is the most sensitive of gingivae areas. When the toothbrush of the invention is angled forty five degrees along a tooth, as shown in FIG. 4, one of the outer-most bristle tuft columns automatically is in position to address the sulcular region with flexible bristles that safely and comfortably, yet effectively, clean plaque from this region.

In a five-column bristle configuration, as shown in FIG. 4, two intermediate bristle tuft columns adjacent to the outer-most columns are of a longer column length and a shorter bristle height. These two factors result in bristles in these columns being more stable and less flexible than those in the outer-most columns. The inner-most column, being the shortest in bristle height as well as longest in column length, is the most stable and least flexible of all bristle tuft columns. Because the inner columns address hard tooth surfaces, rather than the gum line, their stability and relatively less flexibility are optimal for effective removal of plaque from the hard tooth surfaces.

The longer and more flexible intermediate bristle tuft columns adjacent to the inner-most column generally protect the gingival region from the stiffer inner-most region, whereby the gingival region is guarded from that column even during improper brushing. The progression of increased stability and decreased flexibility from the edges of the toothbrush head to the center of the head as provided by the invention thereby enables not only optimal bristle geometry but also optimal bristle flexibility based on specific oral tissue regions to be addressed by specific bristle tuft columns.

In the Bass toothbrushing technique, the sulcular region is specifically cleaned by toothbrush bristles. The toothbrush of the invention enables this technique and further enables simultaneous cleaning of tooth surfaces along with the sulcular region. As mentioned above, the Bass technique is widely accepted as the most effective method for bacterial plaque removal in the sulcular region. Here, the toothbrush is angled at about forty five degrees with respect to a tooth surface, as shown in FIG. 4, by, e.g., first placing the toothbrush parallel with the long axis of the tooth and then turning the toothbrush to the desired angle.

Once at the desired angle, one of the outer-most columns of bristle tufts of the toothbrush is automatically directed straight into the sulcular region. At this point, the toothbrush is to be pressed lightly against the tooth so that the bristles enter the sulcular region and cover the gingival margin but do not substantially bend. Then, the toothbrush is moved back and forth using short strokes and preferably without disengaging the bristles of the outer-most column from the sulcular region. Optimally, at least ten strokes are accomplished. The continuous bristle profile along the entire length of the bristle tuft columns of the toothbrush does not impede this back and forth motion and accomplishes the sulcular cleaning along the entire length of the toothbrush head, which may span several teeth.

After one group of teeth has been cleaned using this procedure, the toothbrush is applied to the next group of teeth, preferably with some amount of overlap with the first group. The stroke pattern is then repeated for the current group. The arching curvature and elliptical cross section of the toothbrush handle enables the Bass sulcular cleaning to be easily and comfortably accomplished even along the interior gum lines and at surfaces of the posterior teeth. The gum line of the entire mouth can therefore be efficiently cleaned in a process enhanced by use of the toothbrush of the invention.

The toothbrush handle and bristle configuration also overcomes problems of the Bass technique typically associated with conventional toothbrushes. For example, the dexterity required to precisely angle a conventional toothbrush at the desired Bass toothbrushing angle may be too high for certain individuals. Also, the so-called rolling toothbrushing technique that is typically used with conventional toothbrushes generally accomplishes very little sulcular brushing and can cause injury to the sulcular region when bristles of a conventional toothbrush are inadvertently or even intentionally pushed into the sulcular region. The toothbrush handle and bristle configurations of the invention overcome these problems to enable comfortable, safe, and effective sulcular cleaning.

Considering further details of the bristles employed in the toothbrush of the invention, the bristles preferably are uniform in size and are formed of a homogeneous material that is resistant to fracture and fraying, has a good ability to repel food debris, and retains its elasticity. Relatively soft bristles with rounded, polished ends rather than cut ends are preferred because they have a lower tendency to cause injury or abrasion to the gingivae; given use of the toothbrush of the invention in the Bass toothbrushing technique, this is especially important for protecting against injury of the sulcular region. The bristles can be round or square, but in either case, should preferably have the desired rounded ends.

The toothbrush of the invention can be manufactured using a wide range of materials and processing techniques. Preferably, the handle is formed of a material that is firm, resilient, and resistant to fracture. Rigid polypropylene, synthetic rubber, or other suitable material can be employed; for example, Cellulocix, from the Eastman Chemical Company, or wood. Preferably, the toothbrush handle is formed of recycled materials that are further recyclable so that the toothbrush can be recycled once the toothbrush bristles are worn out. Given the high volume of toothbrushes thrown away each year, such recycling is prudent in an effort to preserve our natural environment.

In one example manufacturing process in accordance with the invention, recycled plastic, e.g., recycled polypropylene, is used to form the toothbrush handle. Preferably, the recycled polypropylene is natural, i.e., not colored, so that the toothbrush handle can be given any desired color during the manufacturing process. If colored recycled plastic is used, a selected colorant can be added to the plastic to produce a pleasing color resulting from the color mix.

Recycled natural polypropylene can be obtained from, e.g., recycling of consumer goods such as plastic packaging, from recycling of industrial scrap plastic from production lines, or from other sources. Preferably, the toothbrush handle is formed of at least about 90% post-consumer recycled polypropylene, and more preferably formed of at least about 95% post-consumer recycled polypropylene. Post-consumer recycled material is here meant to refer to recycled materials that were recovered after their first use in the application for which they were manufactured. This recycling source has a larger impact on the reduction of the growing volume of waste plastic that is thrown away than other recycling sources such as post-industrial recycling sources, which generally include scrap plastic from production waste. However, most post-consumer recycled plastic is colored, not natural. Thus, in some cases, it may be preferable to use some or all post-industrial recycled plastic, which is more often natural, or to use colorants with colored post-consumer recycled plastic. In any case, it is preferred that the previous use of the plastic be known such that monitoring of the material is possible to screen for any material components or previous applications that would not be compatible with later use of the material as a toothbrush.

Considering the use of recycled post-consumer plastics, in one recycling process scenario in accordance with the invention, crushed plastic structures are first debated, to break apart the bales in which such plastic is typically collected. The plastic is then granulated into a raw flake material, which is cleaned and sifted to remove labels, foils, glue, and other unwanted components. The cleaned, flaked material is then pelletized to produce pellets of the recycled material for formation into toothbrush handles.

Preferably, the plastic material to be recycled for producing the toothbrush handle is cleaned and washed separately from other plastic to be recycled for other purposes. As can be readily understood, the recycled plastic to be used to form the toothbrush handle of the invention is preferably as clean as virgin plastic. Thus, foreign components, such as foil, in the recycled pellets are preferably eliminated, or at least minimized, and care is preferably taken in accomplishing an effective washing and filtering process. As can be recognized, it is preferable that the recycled plastic be cleaned and filtered to an extent that the fraction of foreign elements contained in the plastic is no greater than that of virgin plastic; periodic testing of the plastic should be optimally undertaken to indeed ensure that the foreign element fraction is as low as that of virgin plastic. Cleaned post-consumer natural recycled polypropylene pellets can be obtained from EnviroPlastics, Inc., of Auburn, Me.

In one molding process in accordance with the invention for producing recycled and recyclable toothbrushes, the recycled pellets are melted to produce a moldable melt material. Additives such as colorants, perfumes, fillers for controlling mechanical stiffness, or other desired additives can be blended with the pellets before melting, or can be added to the melt. The melt is then introduced to the hopper of a conventional injection molding machine. The melt is here plasticated and mixed by, e.g., a reciprocating screw unit of the molding machine, to inject a unit of melt through a barrel and into a mold having one or more cavities corresponding to the toothbrush handle shape. The amount of melt injected in one unit into the mold is preferably adequate for one injection molding sequence, which may produce many toothbrush handles, and preferably is about 10% more melt than that exactly required, to provide dimensional control tolerance. The melt is injected through an injection barrel at a temperature of, e.g., between about 375° F. and 475° F., at a back pressure of between about 200 psi and 1000 psi, with a screw rotational speed of between about 50 rpm and 200 rpm. These conditions result in a good quality melt suitable for injection; as will be recognized, however, other injection processing parameters can also be employed.

After the unit of melt is injected into the multi-cavity mold, the mold is closed, and the melt is injected into the distinct cavities. During this process, the mold temperature is preferably controlled to between about 70° F. and 150° F., by, e.g., circulating water through cooling channels in the mold. This temperature range has been shown to result both in acceptable mold quality as well as reasonable cooling times. The speed of the injection into the cavities is preferably controlled to an injection time of about 0.5 to 5 seconds, at melt pressures of between about 3000 psi and 20,000 psi, to produce acceptable molded handle surface quality.

At this point in the process, the plasticating screw is employed as a ram to apply pressure to the mold at the injection orifice, thereby packing the melt in the cavities and holding the melt securely in the mold until the material in the area of the mold orifice solidifies. The packing and holding pressure is preferably between about 2,000 psi and 16,000 psi to minimize toothbrush handle shrinkage and produce good handle surface quality. Depending on the desired surface quality and acceptable degree of shrinkage, the packing and holding pressure can be applied for a time between about 2 seconds and 30 seconds, and can be varied to enable a higher degree of shrinkage control.

At the end of the hold period, cooling of the mold is continued for between about 5 seconds and 60 seconds. After the molded toothbrush handles are sufficiently cool and rigid, the mold is opened, and the toothbrush handles are ejected from the mold using, e.g., mechanical devices such as ejector pins. Just after ejection, the molded toothbrush handles are preferably handled with care, using, e.g., robotic apparatus, to avoid the production of surface defects on the parts. The toothbrush handles are then further ambiently cooled, as is conventional.

The handle grips 36, FIGS. 1–3, provided along the gripping region of the toothbrush of the invention, can be formed integrally to the molded toothbrush handle, or alternatively, can be separately attached to the handle. In the former case, the toothbrush handle mold preferably corresponds to the desired shape and number of the grips. In the latter case, a material other than the handle material can be employed to form the grips; for example, plastic of a color different than that of the handle, synthetic rubber, or other suitable material can be employed to produce the grips.

The injection mold preferably includes core pins in the side of the mold corresponding to the top side of the toothbrush handle, for producing holes in the head region of the toothbrush handle during the molding; these holes are then used to secure bristles to the toothbrush handle after the molding process is completed. Conventional soft toothbrush bristles of any suitable material can be employed; preferably, the bristles are formed of a nylon material. Such bristles can be obtained under the trade name Tynex®, from Dupont Polymers, Wilmington, Del. Bristle materials of any color, wear-indicating bristle materials, or other suitable materials can also be employed.

In one example configuration in accordance with the invention, each core-pinned hole is between about 0.15 cm and 0.2 cm in diameter, and is aligned in a matrix of hole rows and columns in a pattern, e.g., the row and column pattern of FIG. 6, to produce a desired alignment of bristle tufts. As mentioned earlier, the core-pinned holes in adjacent columns are preferably offset from each other by about 1.5 mm.

Bristles are at this point secured in the holes to produce tufts of bristles. Such securing can be accomplished by stapling, pinning, or other suitable process. In one example process, bristle strands are stapled into the holes. Here, the midsection of a strand is inserted into a hole and stapled to the base of the hole with, e.g., a very small wire or other fastening device. The strand is thereby folded by the stapling process to produce two bristles each extending perpendicularly out of the hole.

The bristle strand stapling process can be efficiently accomplished using strands of uniform length throughout the rows and columns of bristle tufts, and thereafter the tufts can be trimmed to desired heights. Recall that in the toothbrush of the invention, the inner-most bristle tuft column is of the smallest height, while the outer bristle tuft columns are of increasing height, with the outer-most columns being of the largest height. Given a five-column bristle tuft configuration like that of either FIG. 5A or 5B, a multistep trimming process can be employed to produce the desired bristle height profile. For either configuration, the first step of an example trimming process is applied to the entire array of bristle tufts to trim the tufts using a conventional flat rotary toothbrush bristle trimmer set for the desired height of the tallest, outer-most bristle tuft columns.

To produce the V-shaped bristle configuration of FIG. 5A, a mechanical spreader is then employed along the length of the toothbrush head to fold the outer-most column on each end of the array out from the other bristle tuft columns. With the outer-most columns folded back, the remaining three bristle tuft columns are then trimmed with the flat rotary trimmer set at the desired height of the intermediate columns adjacent to the outer-most, folded back columns. With this second trimming step, the outer four bristle tuft columns are at their intended height. Next, the mechanical spreader is disengaged from its previous position and repositioned to fold back both the outer-most and intermediate bristle tuft columns, leaving only the inner-most column in its natural position. Then, the inner-most column of bristle tufts is trimmed by the trimmer to its desired height.

To produce the cup-shaped bristle configuration of FIG. 5B, a mechanical spreader is employed, after the first overall trim step, to fold the outer-most column on each end of the array out from the other bristle tuft columns. Then a convex-profile trimmer is applied to the three inner bristle tuft columns simultaneously along the length of the toothbrush head to produce the continuously graded bristle profile across the columns and down their length. This results in the cup profile of FIG. 5B.

As will be understood, various trimming procedures can be employed beyond those just described, and no single trimming apparatus or procedure is required by the invention. Any procedure that enables the formation of a multilevel, bristle tuft configuration, such as a tri-level or graded cup profile configuration, can be employed to produce a toothbrush as contemplated by the invention. For example, the bristle strands can be stapled into the toothbrush handle at their desired height instead of being trimmed by a post-staple process.

Figure 5C:
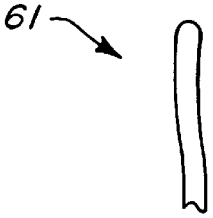
FIG. 5C is a side view of a rounded toothbrush bristle in accordance with the invention.

Whatever fastening and trimming processes are employed, it is preferable that the toothbrush bristles be end-rounded to remove any sharp edges on the ends of the bristles. The particular process selected for end-rounding can be tailored to the particular height profile of the bristle tuft configuration. For example, in one end-rounding process for a five-column bristle tuft array, a mechanical spreader is first positioned to fold back the outer-most bristle tuft column on each end of the bristle tuft array, and then both the inner-most and second and fourth columns are all end-rounded simultaneously, using, e.g., spinning and oscillating disks, as is conventional. Preferably, the bristle tufts are then immediately polished using the spinning and oscillating apparatus. Then, the mechanical spreader is removed and the outer-most bristle tuft columns are end-rounded and polished alone. Thus, depending on the number of and difference in height between the bristle tuft columns, bristle tuft columns of more than one height can be end-rounded and polished simultaneously. As will be recognized, the number of bristle tuft columns and their height differences must be considered in designing an efficient end-rounding and polishing process. Once the end-rounding and polishing process is complete, the toothbrush bristles, like the bristle 61 shown in FIG. 5C are ready for use.

Typically, toothbrush bristles wear over a period of time of use and lose their ability to maintain a perpendicular position with respect to the toothbrush head. At the time of disposal of the toothbrush of the invention, when its bristles are thusly worn out, the toothbrush can be preferably recycled instead of included in non-recyclable trash. Recycling of the entire toothbrush, including, e.g., its nylon bristles, can produce a strong plastic-based material that can be used for, e.g., making plastic lumber or other plastic structures. Being itself substantially produced of recycled materials, the recyclable toothbrush thereby is part of a recycling circle that has minimal impact on the environment, both by reducing the volume of post-consumer plastic that might otherwise expand land fills as well as by providing a product no part of which cannot be included in recycling. As stated earlier, although this recycling circle is preferred in the invention, non-recycled and nonrecyclable materials can alternatively be employed to produce the toothbrush.

From the foregoing, it is apparent that the toothbrush manufacturing process pursuant to the invention and described above enables a viable recycling circle in which recycled materials are used to produce the toothbrush, which itself is entirely recyclable. But equally importantly, the toothbrush handle and bristle configurations provided by the invention and described above provide substantial functional advantages for promoting the Bass toothbrushing technique. Indeed, the toothbrush handle arching profile and elliptical cross section facilitates a comfortable and simple angling of the toothbrush for cleaning both the interior and exterior gum lines of both posterior and anterior teeth. Furthermore, the toothbrush bristle configuration of the invention goes beyond enablement of the Bass toothbrushing technique to enable simultaneous plaque removal from sulcular regions as well as tooth surfaces. It is recognized, of course, that those skilled in the art may make various modifications and additions to the embodiments described above without departing from the spirit and scope of the present contribution to the art. Accordingly, it is to be understood that the protection sought to be afforded hereby should be deemed to extend to the subject matter claims and all equivalents thereof fairly within the scope of the invention.

We claim:

1. A toothbrush comprising:

a head region in which is secured bristles on a top side of the head region along at least a portion of the head region;

a neck region connected to the head region;

an elongated gripping region connected to the neck region, the neck and head regions each being angled backward from the gripping region at a common backward angle with respect to the gripping region;

an end rest region connected to the gripping region, the gripping region arching frontward of both the neck and end rest regions; and a support region connected between the gripping region and the end rest region, the gripping region arching frontward of the support region and the support region curving backward toward the end rest region.

2. A toothbrush comprising:

a head region in which is secured bristles on a top side of the head region along at least a portion of the head region;

a neck region connected to the head region;

an elongated gripping region connected to the neck region, the neck and head regions each being angled backward from the gripping region at a common backward angle of between about ten degrees and about twenty degrees with respect to the gripping region; and an end rest region connected to the gripping region, the gripping region arching frontward of both the neck and end rest regions.

3. The toothbrush of either of claims 1 or 2 wherein each of the neck region and gripping region are characterized by an elliptical cross section.

4. The toothbrush of either of claims 1 or 2 wherein the head region, the neck region, the gripping region, and the end region each comprise at least about 90% recycled plastic.

5. The toothbrush of either of claims 1 or 2 further comprising at least one handle grip protruding from a surface of the toothbrush at a location in the gripping region.

6. The toothbrush of either of claims 1 or 2 wherein the head, neck, gripping, and end rest regions each comprise a material composition at least a portion of which comprises recycled plastic that can again be recycled.

7. The toothbrush of claim 6 wherein the recycled plastic comprises recycled polypropylene.

8. The toothbrush of claim 6 wherein at least a portion of the recycled plastic comprises post-consumer recycled plastic.

9. The toothbrush of claim 6 wherein the material composition comprises at least about 90% recycled plastic.

10. The toothbrush of claim 6 wherein the bristles comprise nylon bristles.

11. The toothbrush of claim 1 wherein the neck region, gripping region, and support region each are characterized by an elliptical cross section.

12. A toothbrush comprising:

a head region in which is secured bristles on a top side of the head region along at least a portion of the head region, the bristles comprising a row of columns of spaced-apart tufts of rounded bristles, an inner-most column of bristle tufts being a first height along the entire inner-most column length, outer-most bristle tuft columns each being a second height that is greater than the first height along the entire outer-most columns' lengths, and intermediate bristle tuft columns each being an intermediate height that is between the first and second heights along the entire intermediate bristle tuft columns' lengths;

a neck region connected to the head region;

an elongated ripping region connected to the neck region, the neck and head regions each being angled backward from the gripping region; and an end rest region connected to the gripping region, the gripping region arching frontward of both the neck and end rest regions.

13. The toothbrush of claim 12 wherein the inner-most bristle tuft column is of a first length, the outer-most bristle tuft columns are each of a second length that is less than the first length, and the intermediate bristle tuft columns are each of an intermediate length that is between the first and second lengths.

14. The toothbrush of claim 13 wherein bristle tufts in each column are offset length-wise from bristle tufts in adjacent columns.

15. The toothbrush of claim 14 wherein the array of bristle tufts comprises five bristle tuft columns.

16. A toothbrush comprising:

a head region in which is secured bristles on a top side of the head region along at least a portion of the head region the bristles comprising a row of spaced-apart tufts of rounded bristles, an inner-most column of bristle tufts being of a first height along the entire inner-most column length, outer-most bristle tuft columns each being a second height that is greater than the first height along the entire outer-most columns' lengths, and intermediate bristle tuft columns each being an intermediate height that is between the first and second heights along the entire intermediate bristle tuft columns' lengths;

a neck region connected to the head region;

an elongated gripping region connected to the neck region, the neck and head regions each being angled backward from the gripping region at a common backward angle with respect to the gripping region; and an end rest region connected to the gripping region, the gripping region arching frontward of both the neck and end rest regions, and the head, neck, gripping, and end rest regions each comprising a material composition at least a portion of which comprises recycled plastic that can again be recycled.

17. A toothbrush comprising:

an elongated handle region; and a head region connected to the handle region and in which is secured bristles on a top side of the head region along at least a portion of the length of the head region, the bristles comprising a row of columns of spaced-apart tufts of rounded bristles, an inner-most column of bristle tufts being a first length along the head and a first height along the entire inner-most column length, outer-most bristle tuft columns each being a second length along the head that is less than the first length and a second height that is greater than the first height along the entire outer-most columns' lengths, and intermediate bristle tuft columns each being an intermediate length along the head that is between the first and second lengths and an intermediate height that is between the first and second heights along the entire intermediate bristle tuft columns' lengths.

18. A toothbrush comprising:

a head region in which is secured bristles on a top side of the head region along at least a portion of the head region;

a neck region connected to the head region;

an elongated gripping region connected to the neck region, the neck and head regions each being angled backward from the gripping region at a common backward angle with respect to the gripping region;

an end rest region connected to the gripping region, the gripping region arching frontward of both the neck and end rest regions; and at least one handle grip protruding from the toothbrush and encircling the toothbrush at a location in the gripping region.

19. A toothbrush comprising:

a head region in which is secured bristles on a top side of the head region along at least a portion of the head region;

a neck region connected to the head region;

an elongated gripping region connected to the neck region, the neck and head regions each being angled backward from the gripping region at a common backward angle with respect to the gripping region; and an end rest region connected to the gripping region and having a generally flat bottom surface, the gripping region arching frontward of both the neck and end rest regions.

* * * * *